US006247272B1

(12) United States Patent
Shipman

(10) Patent No.: US 6,247,272 B1
(45) Date of Patent: Jun. 19, 2001

(54) CURVED DOOR ASSEMBLY FOR WORKSTATION

(75) Inventor: David A. Shipman, Grand Rapids, MI (US)

(73) Assignee: Steelcase Development Inc., Grand Rapids, MI (US)

( * ) Notice: Subject to any disclaimer, the term of this patent is extended or adjusted under 35 U.S.C. 154(b) by 0 days.

(21) Appl. No.: 09/210,071

(22) Filed: Dec. 11, 1998

(51) Int. Cl.[7] ..... E06B 3/46; A47F 10/00

(52) U.S. Cl. ..... 52/29; 52/36.1; 52/207; 52/239; 49/40; 49/41

(58) Field of Search ..... 49/41, 40, 409, 49/410, 425; 52/27.5, 32, 36.1, 65, 207, 238.1, 239, 245, 29; 379/453

(56) References Cited

U.S. PATENT DOCUMENTS

| | | | | |
|---|---|---|---|---|
| 478,505 | | 7/1892 | Eglin . | |
| 822,493 | | 6/1906 | Turner . | |
| 878,395 | * | 2/1908 | Holsters . | |
| 1,334,132 | * | 3/1920 | Collins et al. . | |
| 1,780,251 | * | 11/1930 | Teplow . | |
| 1,829,256 | * | 10/1931 | Benzger . | |
| 2,028,627 | * | 1/1936 | Sherron . | |
| 2,028,628 | * | 1/1936 | Sherron . | |
| 2,154,641 | | 4/1939 | Seaman . | |
| 3,427,768 | | 2/1969 | Fulton . | |
| 3,498,011 | | 3/1970 | Lindgren . | |
| 3,613,314 | * | 10/1971 | Ford . | |
| 3,862,525 | | 1/1975 | Greenspan . | |
| 4,198,785 | | 4/1980 | Marulic et al. . | |
| 4,244,302 | * | 1/1981 | Stine | 49/41 X |
| 4,282,689 | | 8/1981 | Royer . | |
| 4,348,966 | | 9/1982 | Hastings . | |
| 4,475,465 | | 10/1984 | Hastings . | |
| 4,571,898 | | 2/1986 | LeCacheaux et al. . | |
| 4,598,495 | | 7/1986 | Labarile . | |
| 4,681,044 | | 7/1987 | Dallman . | |
| 4,833,829 | * | 5/1989 | Wilson | 49/426 |
| 4,850,145 | * | 7/1989 | McAfee | 49/501 |
| 4,928,429 | | 5/1990 | Colombo . | |
| 5,125,202 | | 6/1992 | Kissinger . | |
| 5,282,341 | | 2/1994 | Baloga et al. . | |
| 5,287,655 | * | 2/1994 | Harvey | 49/425 |
| 5,452,547 | | 9/1995 | Baloga et al. . | |
| 5,605,014 | * | 2/1997 | Kimura | 49/40 |
| 5,653,063 | * | 8/1997 | Barnett et al. | 52/29 |
| 5,687,513 | * | 11/1997 | Baloga et al. | 52/32 |
| 5,746,034 | | 5/1998 | Luchetti et al. . | |
| 5,746,035 | | 5/1998 | Seiber et al. . | |
| 5,784,843 | | 7/1998 | Greer et al. . | |
| 5,816,001 | | 10/1998 | Goodman et al. . | |
| 5,873,205 | | 2/1999 | Hanlon et al. . | |
| 5,966,879 | * | 10/1999 | Verbeek et al. | 52/205 |
| 6,073,394 | * | 6/2000 | Uhl | 49/41 |

FOREIGN PATENT DOCUMENTS

| | | | | |
|---|---|---|---|---|
| 1467369 | * | 9/1979 | (GB) | 49/41 |
| 685795 | * | 9/1979 | (SU) | 49/40 |

* cited by examiner

*Primary Examiner*—Robert Canfield
(74) *Attorney, Agent, or Firm*—Price, Heneveld, Cooper, DeWitt & Litton

(57) ABSTRACT

A combination door assembly and partition system includes a plurality of partition panels configured to be abuttingly supported on a floor surface and detachably interconnected to form a workspace having an opening of sufficient size to permit user ingress and egress therethrough. The shape and size of the workspace in plan view can be readily varied. The door assembly includes a curved support panel having a curved bilinear plan shape. The curved support panel is interconnected with the partition system adjacent the opening of the partition system adjacent the opening of the workspace. A curved door having a curved bilinear plan shape is slidably interconnected with the curved support panel and defines a lower edge. At least one roller is mounted adjacent to the lower edge of the curved door for movably supporting the curved door on a floor surface. The door is movable between an opened position providing user ingress and egress through the opening and a closed position wherein the door substantially closes off the opening.

29 Claims, 4 Drawing Sheets

CURVED DOOR ASSEMBLY FOR WORKSTATION

BACKGROUND OF THE INVENTION

The present invention relates to a sliding curved door that can be readily connected to a partitioned workspace of the type that can have the interior shape and size readily varied.

Open office plans have been developed to reduce overall costs and generally incorporate large open floor spaces in buildings that are equipped with modular furniture systems which are readily reconfigurable to accommodate the ever changing needs of a specific user, as well the divergent requirements of different tenants. One arrangement commonly used for furnishing open plans includes movable partition panels that are detachably interconnected to partition off the open spaces into individual workstations and/or offices. Such partition panels are configured to receive hang-on furniture units, such as work surfaces, overhead cabinets, shelves, etc., and are generally known in the office furniture industry as "systems furniture." Another arrangement for dividing and/or partitioning open plans includes modular furniture arrangements, in which a plurality of differently shaped freestanding furniture units are positioned in a side-by-side relationship, with upstanding privacy screens attached to at least some of the furniture units to create individual distinct workstations and/or offices. Both of these types of modular furniture systems, as well as others, have been widely received largely due to their ability to be readily reconfigured and/or moved to a new site, since they are not part of a permanent leasehold improvement.

Because the partitioned panels are detachably interconnected to form the individual workspaces, the size and shape of the workspaces can be readily varied to accommodate changing requirements of the workers. The partition panels are generally configured to provide an opening for user ingress and egress to the workspace. However, the opening necessarily limits the privacy available to a worker within the workspace. Although doors have been developed to provide some degree of privacy, existing doors have a flat, planar configuration corresponding to the partition panels, such that the floor space within the workspace is limited to a rectilinear configuration.

SUMMARY OF THE INVENTION

One aspect of the present invention is to provide a combination door assembly and partition system. The partition system includes a plurality of partition panels configured to be abuttingly supported on a floor surface and detachably interconnected to form a workspace having an opening of sufficient size to permit user ingress and egress therethrough. The shape and size of the workspace in plan view can be readily varied. The door assembly includes a curved support panel having a curvilinear plan shape. The curved support panel is interconnected with the partition system adjacent the opening of the partition system. A curved door having a curvilinear plan shape is slidably interconnected with the curved support panel and defines a lower edge. At least one roller is mounted adjacent the lower edge of the curved door for movably supporting the curved door on a floor surface. The door is movable between an opened position providing user ingress and egress through the opening and a closed position wherein the door substantially closes off the opening to provide privacy within the workspace.

Another aspect of the present invention is a door assembly having construction facilitating connection to partition systems of the type having a plurality of partition panels abuttingly supported directly on a floor surface and detachably interconnected to form a workspace having an opening permitting user ingress and egress therethrough, and wherein the shape and size of the workspace in plan view can be readily varied. The door assembly includes a door having a curved plan shape and defining a lower edge. At least one roller is mounted to the door adjacent the lower edge for movably supporting the door on a floor surface. The door shifts between an opened position permitting user ingress and egress through the opening and a closed position substantially closing off the opening.

Yet another aspect of the present invention is in a partition system of the type having a plurality of partition panels, each configured to be supported on a floor surface and detachably interconnected to form a workspace having an opening for worker ingress and egress therethrough, and wherein the panels are detachably interconnected to one another in a manner permitting the shape and size of the workspace in plan view to be readily varied. The partition panels form a generally rectilinear perimeter of the workspace in plan view. The improvement including a door having a curved plan shape and shifting between an opened position permitting user ingress and egress through the opening in the workspace and a closed position substantially closing off the opening. The door projects outwardly beyond the rectilinear perimeter when in the closed position to capture space outside the rectilinear perimeter, thereby providing increased user space within the workspace when the door is in the closed position.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
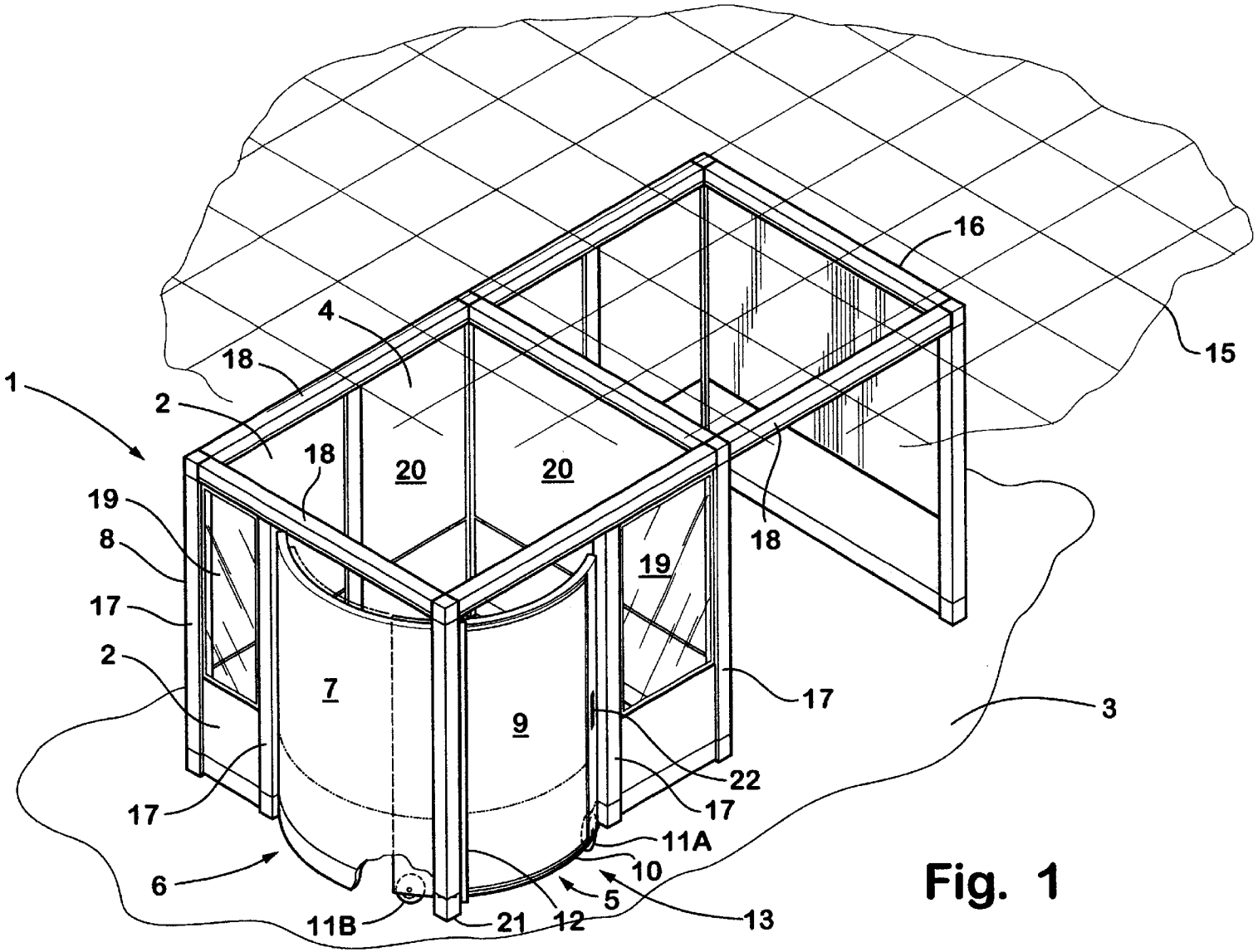
FIG. 1 is a fragmentary perspective view of a combination door assembly and partition system embodying the present invention.

For purposes of description herein, the terms "upper," and "lower," "right," "left," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specifications are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
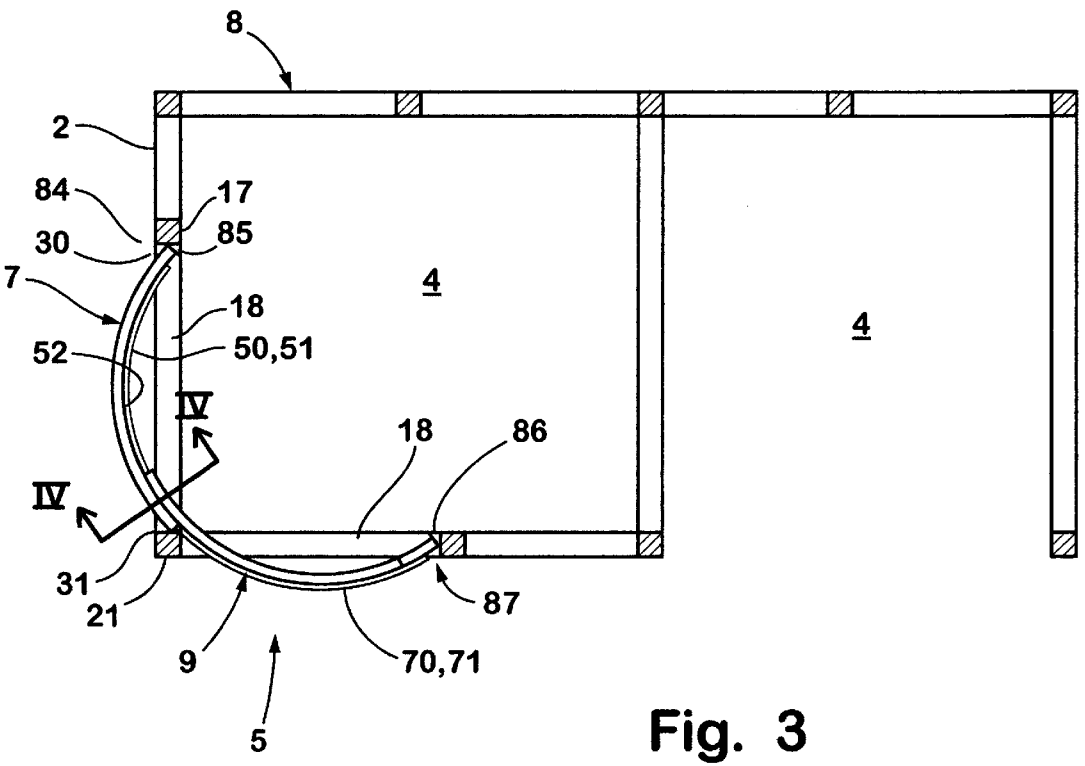
FIG. 3 is a top plan view of the door assembly and partition system of FIG. 1.

The reference numeral 1 (FIG. 1) generally designates a combination door assembly and partition system embodying the present invention, which is particularly designed for use in open office plans and other similar settings and environments. In the illustrated example, a plurality of partition panels 2 are configured to be supported on a floor surface 3 and detachably interconnected to form a workspace 4 having an opening 5 of sufficient size to permit user ingress and egress therethrough. Because the partition panels 2 are detachably interconnected, the shape and size of the workspace 4 in plan view can be readily varied. The door assembly 6 includes a curved support panel 7 having a curvilinear plan shape that is preferably arcuate (FIG. 3). The curved support panel 7 is interconnected with the partition system 8 adjacent the opening 5 of the workspace 4. A curved door 9 defines a lower edge 10 and has a curvilinear plan shape that is preferably arcuate. Door 9 is sidably interconnected with the curved support panel 7. At least one roller, such as wheel 11A or 11B, is mounted adjacent the lower edge 10 of the curved door 9 for movably supporting the curved door 9 on a floor surface 3. The curved door is movable between an opened position 12 providing user ingress and egress through the opening 5, and a closed position 13 wherein the door 9 substantially closes off the opening to provide privacy within the workspace 4.

The partition system 8 illustrated in FIG. 1 is a partial-height partition panel system having a free upper edge that is spaced downwardly from the ceiling 15. As described in more detail below, door assembly 6 may be used with a floor-to-ceiling partition system 35 illustrated in FIG. 2. Examples of these partition panel systems can be found in U.S. Pat. No. 5,816,001 entitled Partition Construction Including Interconnection System and Removable Covers; U.S. Pat. No. 5,746,034 entitled Portable Partition System; U.S. Pat. No. 5,746,035 entitled Partition System; and U.S. Pat. No. 5,784,843 entitled Integrated Prefabricated Finish System for Building Space; the entire contents of each of which are hereby incorporated by reference. The illustrated partition system 8 includes a plurality of vertical uprights 17 that are interconnected with horizontal overhead cross-members 18 and a plurality of solid panels 20 and clear panels 19 that are interconnected to form the workspace 4. Workspace 4 preferably includes a vertical upright 21 forming a corner of the workspace adjacent door assembly 6. Upright 21 is positioned directly adjacent a first side of the opening 5, such that the curved support panel 7 extends between upright 21 and the adjacent partitioned panel 2. As best seen in FIG. 3, the curved support panel 7 and the door 9 have an arcuate plan shape that captures space within the workspace 4, providing increased area for a user compared to a workspace having rectilinear plan shape formed solely by conventional flat doors and/or partition panels. Furthermore, because the door 9 slides generally parallel to the curved support panel 7, additional clearance for door movement is not required as with conventional swinging door arrangements. When closed, door 9 is positioned directly adjacent curved support panel 7, such that the radii defined by the door 9 and panel 7 are concentric. This provides a compact arrangement that maximizes the usable floor space in and adjacent the workspace 4.

Figure 2:
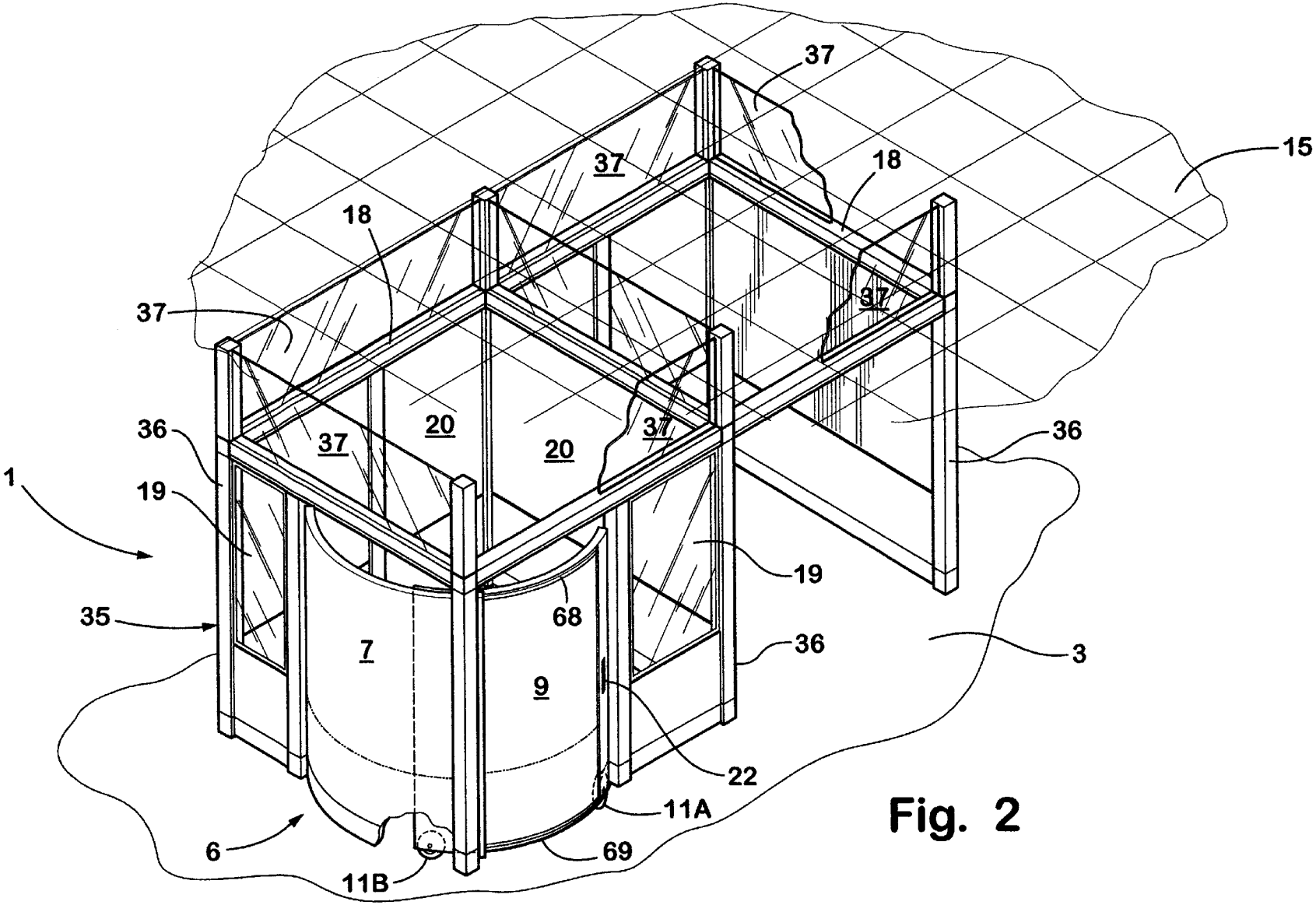
FIG. 2 is a fragmentary perspective view of a full-height partition system including a curved door assembly.

A second type of partition system 35 is illustrated in FIG. 2. Partition system 35 is substantially the same as partition system 8 illustrated in FIG. 1, except that vertical uprights 36 extend upwardly to the ceiling 15 to provide a full-height partition system for increased user privacy. Clear sheets 37 may be installed above the overhead cross-members 18 to close off the area between the overhead cross-members 18 and the ceiling 15. Because the curved door 9 is supported on the floor surface 3 by wheels 11A and 11B, the curved support panel 7 can be readily connected to a variety of conventional partition panels without requiring extensive weight-supporting guide structures and the like.

Figure 4:
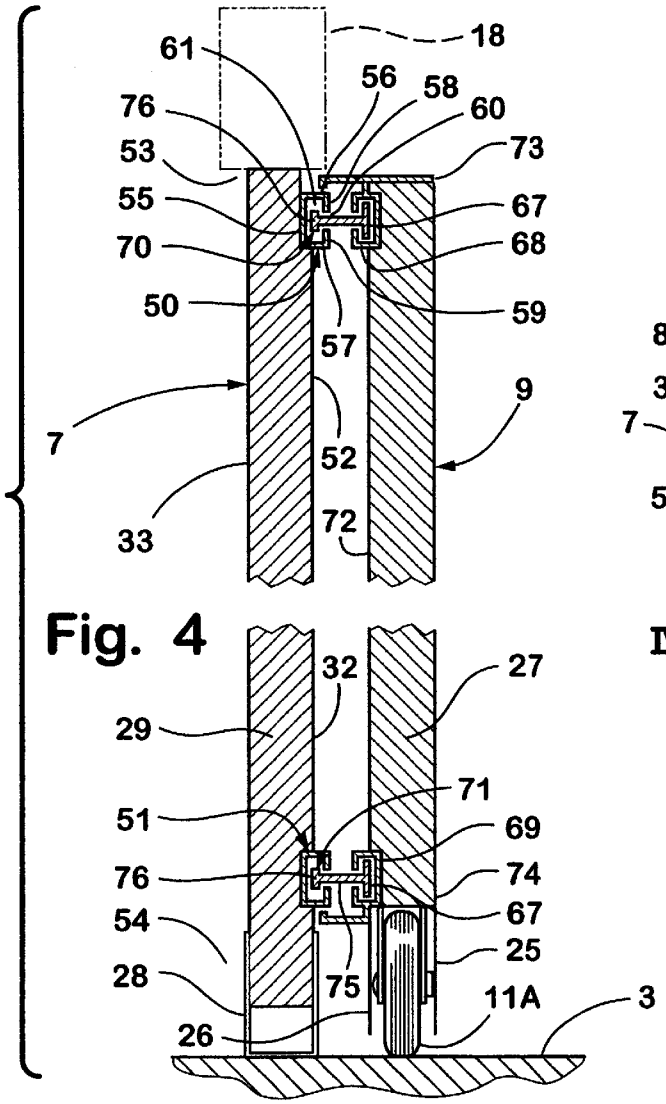
FIG. 4 is a fragmentary cross-sectional view of the curved door and curved support panel taken along the line IV—IV in FIG. 3.

With further reference to FIG. 4, door 9 includes an inner skin or cover 25 and an outer skin or cover 26. Covers 25 and 26 extend downwardly to cover the wheels 11. Door 9 has a substantially conventional construction with a steel perimeter frame (not shown) and a core panel 27 made of a conventional sound-absorbing material used for partition panel systems. Door 9 includes a recessed area 22 forming a handle. Curved support panel 7 also includes a conventional perimeter frame 28 made of steel or other suitable material, with a core panel 29 made of a suitable conventional sound-absorbing material. The side edges 30 and 31 of curved support panel 7 are secured to the adjacent vertical uprights 17 and 21 by means of brackets (not shown) or other conventional fastening arrangement. The inner and outer skins or covers 32 and 33 of curved panel 7, as well as skins 25 and 26 of door 9, have fabric or other material on the outer surface that is the same as the outer surface material of the solid (straight) panels 20 of the partition system 8 to thereby provide a uniform integrated appearance.

Upper and lower C-channels 50 and 51 are secured to the panel frame along inner side 52 of curved support panel 7 adjacent the upper and lower edges 53 and 54, respectively, using conventional fasteners (not shown) or other suitable connectors. C-channels 50 and 51 are substantially identical, and are each made of extruded and/or roll-formed aluminum or other suitable material. C-channels 50 and 51 each include a vertical base wall 55 and horizontally extending upper and lower horizontal walls 56 and 57 that terminate in a downwardly extending flange 58 and an upwardly extending flange 59, respectively. The edges of flanges 58 and 59 are spaced apart to define an elongated horizontally extending slot or opening 60, with an elongate cavity 61 defined within each C-channel 50 and 51. As best seen in FIG. 3, C-channels 50 and 51 have an arcuate plan shape and fit closely against inner side 52 of curved support panel 7. Upper and lower extensions 70 and 71 each include a vertical base web 67 that is positioned and secured within C-channels 68 and 69. C-channels 68 and 69 have substantially the same cross-sectional shape and construction as C-channels 50, 51, and are secured to the door frame along outer side face 72 of curved door 90 by conventional fasteners (not shown) or other suitable connectors. Upper and lower extensions 70 and 71 are elongated with an arcuate plan shape (FIG. 3) corresponding to C-channels 50, 51, 68, and 69. Upper and lower extensions 70 and 71 are substantially identical and include a horizontally extending web 75 that terminates at a generally T-shaped end portion 76 disposed within cavity 61 of upper and lower C-channels 50 and 51. Upper extension 70 is positioned immediately adjacent the upper edge 73 of curved door 9, and lower extension 71 is positioned immediately adjacent the lower edge 74 of the curved door 9. Extensions 70 and 71 are relatively small, such that the C-channels 68 and 69, with extensions 70 and 71, provide an unobtrusive appearance similar to an edge trim member. Extensions 70 and 71 are preferably made of a low-friction polymer material and are slidably received within the C-channels 50 and 51. Extensions 70 and 71 guide the curved door 9 and provide a sliding interconnection between the curved door 9 and curved support panel 7.

Figure 6:
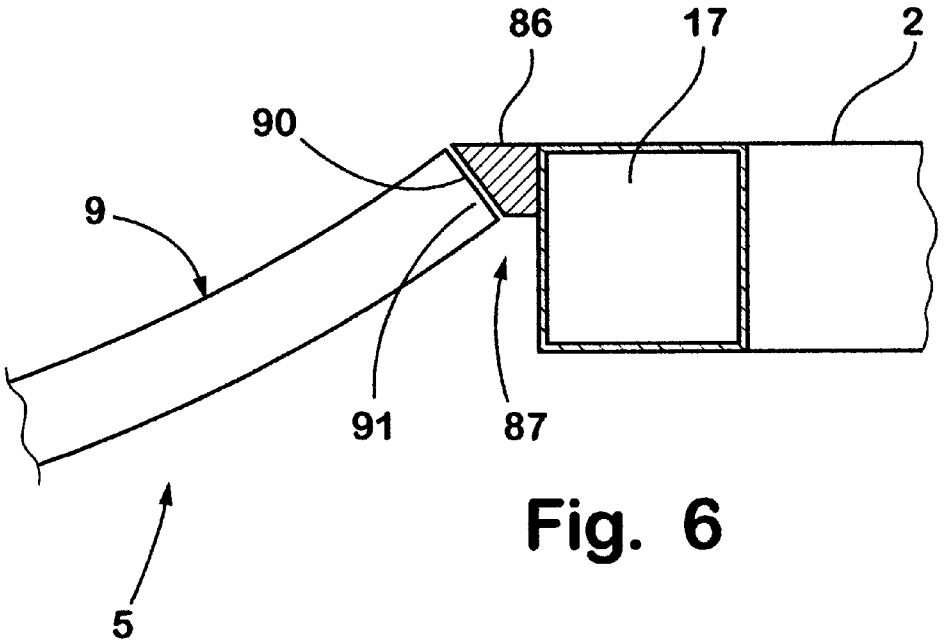
FIG. 6 is a fragmentary top plan view showing a second wedge strip that provides a doorstop for the curved door.
Figure 5:
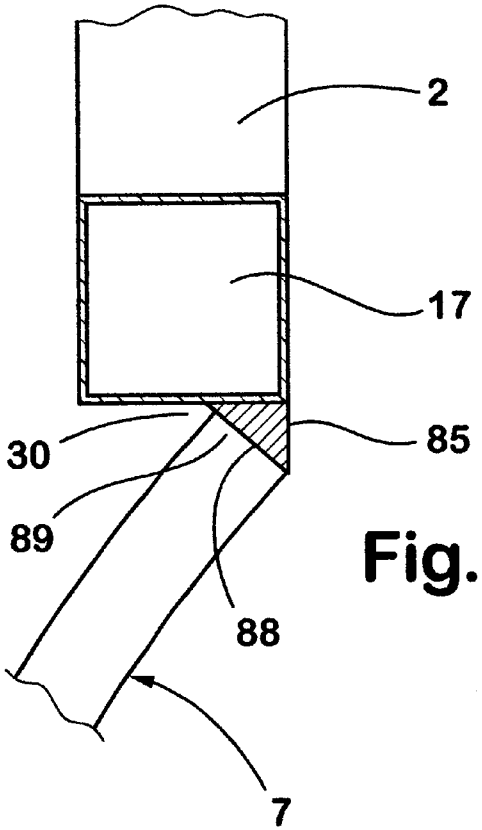
FIG. 5 is a fragmentary top plan view of a first wedge strip used to connect the curved support panel to a partition panel.

As discussed above, at least one wheel 11A or 11B is rotatably mounted to the curved door 9 adjacent the lower edge 10 thereof. Wheels 11A and 11B movably support the curved door 9 on a floor surface 3, such that C-channels 50 and 51 and extensions 70 and 71 do not support a substantial portion of the weight of the door 9 during normal operation. In a preferred embodiment, wheel 11A is relatively large to provide a more pleasing aesthetic appearance. With reference to FIGS. 5 and 6, a first vertical wedge strip 85 interconnects the first side edge 30 of curved support panel 7 to the side edge 84 (see also FIG. 3) of partition panel 2 formed by vertical upright 17. Similarly, a second wedge strip 86 connects to the side edge of a partition panel 2 formed by vertical upright 17 positioned along a second side 87 of the opening 5. Angled side face 88 of first wedge strip 85 closely corresponds to a side edge 89 of curved support panel 7. Wedge strip 85 can be configured to provide attachment of the curved support panel 7 to a variety of standard partition panels. As known in the art, conventional partition panels include various types of connectors along the side edges of the panels for interconnection with adjacent panels. Accordingly, wedge strip 85 can be configured to include a standard connecting arrangement corresponding to a given panel system, thereby permitting connection of the wedge strip 85 and curved support panel 7 to the panel system. The second wedge strip 86 acts as a door jamb or stop, and can be configured to include a standard connecting arrangement for securing wedge strip 86 to the side edge of a selected standard panel, in the same manner as described above with respect to wedge strip 85. Angled side face 90 of wedge strip 86 closely corresponds to the side edge 91 of the curved door 9 to seal the side edge of the opening when the door 9 is in the closed position 13. Wedge strips 85 and 86 may be fabricated from extruded aluminum, roll-formed steel, or other suitable construction as required to incorporate the edge fastening arrangement of a particular partition system. Door 9 and wedge strip 86 may incorporate a conventional door latch and/or lock mechanism (not shown) to secure the door 9 in the closed position.

Because the curved support panels 7 and curved door 9 project outwardly from the rectilinear perimeter of the workspace 4, the door assembly 6 provides increased user space within the workspace 4 when the door 6 is in the closed position. However, when door 9 is in the open, or retracted, position, door 9 is disposed substantially parallel to the curved support panel 7 in a concentric manner, thereby minimizing the floor space taken up by the door 9. Furthermore, when door 9 is closed, the floor space directly in front of opening 5 is not obstructed, thereby minimizing obstruction of the floor space adjacent workspace 4.

In the foregoing description, it will be readily appreciated by those skilled in the art that I modifications may be made to the invention without departing from the concepts disclosed herein. Such modifications are to be considered in the following claims, unless these claims by their language expressly state otherwise.

The invention claimed is:

1. A combination door assembly and partition system, said partition system comprising:

a plurality of partition panels configured to be abuttingly supported on a floor surface and detachably interconnected to form a workspace having an opening of sufficient size to permit user ingress and egress therethrough, and wherein the shape and size of the workspace shape in plan view can be readily varied; said door assembly comprising:

a curved support panel having a curvilinear plan shape, said curved support panel interconnected with said partition system adjacent said opening of said workspace;

a curved door having a curvilinear plan shape slidably interconnected with said curved support panel, said door defining a lower edge;

at least one roller mounted on said curved door adjacent said lower edge of said curved door, said at least one roller adapted to movably support said curved door on a floor surface; and said curved door movable between an opened position providing user ingress and egress through said opening and a closed position wherein said door substantially closes off said opening to provide privacy within said workspace.

2. A combination door assembly and partition system as set forth in claim 1, wherein:

said curved support panel defines an inner side; and said door is disposed along said inner side in an overlapping relationship therewith when in said opened position.

3. A combination door assembly and partition system as set forth in claim 2, wherein:

said roller comprises a pair of spaced-apart wheels rotatably mounted to said door.

4. A combination door assembly and partition system as set forth in claim 3, wherein:

one of said curved support panel and said door includes vertically spaced-apart upper and lower horizontal guides; and the other of said door and said curved support panel includes upper and lower extensions slidably engaging said upper and lower guides.

5. A combination door assembly and partition system as set forth in claim 1, wherein:

at least one of said partition panels includes a decorative cover made of a selected material and defining a side face of said partition panel; and said door includes a decorative cover made from said selected material to provide substantially the same appearance and acoustic properties as said decorative cover of said partition panel.

6. A combination door assembly and partition system as set forth in claim 5, wherein:

said decorative cover of said door includes a sound-absorbing layer of material to provide improved acoustics within said workspace.

7. A combination door assembly and partition system as set forth in claim 1, wherein:

said workspace includes a first partition panel having a flat outer face, said curved support panel having a vertical side edge positioned adjacent said first partition panel; and wherein said curved support panel extends outwardly of said flat outer face of said first partition panel to provide increased area within said workspace for a user.

8. A combination door assembly and partition system, said partition system comprising:

a plurality of partition panels configured to be abuttingly supported on a floor surface and detachably interconnected to form a workspace having an opening of sufficient size to permit user ingress and egress therethrough, and wherein the shape and size of the workspace shape in plan view can be readily varied; said door assembly comprising:

a curved support panel having a curvilinear plan shape, said curved support panel interconnected with said partition system adjacent said opening of said workspace;

a curved door having a curvilinear plan shape slidably interconnected with said curved support panel, said door defining a lower edge;

at least one roller mounted adjacent said lower edge of said curved door for movably supporting said curved door on a floor surface;

said curved door movable between an opened position providing user ingress and egress through said opening and a closed position wherein said door substantially closes off said opening to provide privacy within said workspace;

said curved support panel defining an inner side;

said door is disposed along said inner side in an overlapping relationship therewith when in said opened position;

said roller comprising a pair of spaced-apart wheels rotatably mounted to said door;

one of said curved support panel and said door including vertically spaced-apart upper and lower horizontal guides;

the other of said door and said curved support panel includes upper and lower extensions slidably engaging said upper and lower guides; and wherein;

said upper and lower guides comprise channels disposed on said inner side of said curved support panel, said channels having a C-shaped cross section, said channels extending along said inner side of said curved support panel in an arcuate manner; and said extensions comprise elongated rails having a T-shaped cross section slidably disposed within said C-shaped channels.

9. A combination door assembly and partition system as set forth in claim 8, wherein:

said channels and said elongated rails are made of a low friction polymer material.

10. A combination door assembly and partition system as set forth in claim 9, wherein:

at least one partition panel is disposed between a pair of side-by-side workstations; and said door is disposed parallel to said curved support panel when in said open position.

11. A combination door assembly and partition system as set forth in claim 10, wherein:

said partition system includes an upright frame member defining a corner of said workspace, said upright frame member disposed adjacent a first side of said opening;

said curved support panel having a vertical side edge adjacent a first side of said upright frame member; and said door extends away from an opposite side of said upright when in a closed position.

12. A combination door assembly and partition system as set forth in claim 11, wherein:

said partition panels comprise partial-height panels having an upper edge spaced apart from a ceiling.

13. A combination door assembly and partition system as set forth in claim 11, wherein:

at least one of said partition panels is a full-height panel extending upwardly to the ceiling.

14. A combination door assembly and partition system as set forth in claim 13, wherein:

at least one of said partition panels has a horizontally extending overhead frame member spaced downwardly from the ceiling; and including a light-transmitting sheet extending between said overhead frame member and the ceiling.

15. A partition system of the type having a plurality of partition panels abuttingly supported directly on a floor surface and detachably interconnected to form a workspace having an opening permitting user ingress and egress therethrough, and wherein the shape and size of the workspace in plan view can be readily varied, said partition system including a door assembly comprising;

a door having a curved plan shape and defining a lower edge;

at least one roller mounted to said door adjacent said lower edge, said at least one roller adapted to movably support said door on a floor surface; and said door shifting between an opened position permitting user ingress and egress through the opening and a closed position substantially closing off the opening.

16. A partition system as set forth in claim 15, wherein:

said door includes a pair of wheels rotatably mounted along said lower edge for movably supporting said door directly on a trackless floor surface.

17. A partition system as set forth in claim 15, including:

a curved support panel having a construction facilitating interconnection with a partition panel; and wherein said door is slidably connected to said curved support panel.

18. A partition system as set forth in claim 17, wherein:

one of said door and said curved support panel includes an elongated arcuate guide disposed between said curved support panel and said door and slidably interconnecting the same.

19. A partition system as set forth in claim 18, including:

an elongated channel connected to one of said door and said curved support panel; and an extension on the other of said door and said curved support panel slidably received within said elongated channel and slidably interconnecting said door and said curved support panel.

20. A partition system as set forth in claim 19, wherein:

said door is disposed generally parallel to said curved support panel when in said opened position.

21. A partition system as set forth in claim 20, wherein:

said elongated channel and said extension define a first slide assembly; and including a second slide assembly vertically spaced apart from said first slide assembly and slidably interconnecting said door and said curved support panel.

22. A partition system as set forth in claim 21, wherein:

said first and second slide assemblies have substantially identical constructions.

23. A partition system as set forth in claim 22, wherein:

said channels have a C-shaped cross-section; and said extensions have a T-shaped portion slidably received within said channels.

24. A partition system as set forth in claim 23, wherein:

said door has a fabric cover that is substantially the same as the other partition panels in the partition system.

25. In a partition system of the type having a plurality of partition panels, each configured to be supported on a floor surface and detachably interconnected to form a workspace having an opening for user ingress and egress therethrough, and wherein the panels are detachably interconnected to one another in a manner permitting the shape and size of the workspace in plan view to be readily varied, said partition panels forming a generally rectilinear perimeter of said workspace in plan view, the improvement comprising:

a door having a curved plan shape and including a wheel rotatably mounted thereto for movably supporting said door on a floor surface; and said door shifting between an opened position permitting user ingress and egress through said opening in said workspace and a closed position substantially closing off said opening, said door projecting outwardly beyond said rectilinear perimeter when in said closed position to capture space outside said rectilinear perimeter, thereby providing increased user space within said workspace.

26. A partition system as set forth in claim 25, including:

a curved support panel connected to said partition system and projecting outwardly beyond said rectilinear perimeter to capture space outside said rectilinear perimeter; and wherein said door is disposed parallel to said curved support panel when in said open position.

27. A partition system as set forth in claim 26, wherein:

said curved support panel defines an inner side; and said door is disposed along said inner side in an overlapping relationship therewith when in said opened position.

28. A partition system as set forth in claim 27, wherein:

said curved support panel includes vertically spaced apart upper and lower guides extending horizontally along said inner side; and said door includes upper and lower extensions slidably engaging said upper and lower guides.

29. A partition system as set forth in claim 28, wherein:

said upper and lower guides comprise channels having a C-shaped cross section, said channels extending along said inner side of said curved support panel; and said extensions have a T-shaped portion slidably disposed within said C-shaped channels.

* * * * *